US008890428B2

(12) United States Patent
Ahn et al.

(10) Patent No.: US 8,890,428 B2
(45) Date of Patent: Nov. 18, 2014

(54) APPARATUS AND METHOD FOR DRIVING LIGHT SOURCE IN BACKLIGHT UNIT

(71) Applicant: LG Display Co., Ltd., Seoul (KR)

(72) Inventors: Younghun Ahn, Seoul (KR); Jongdae Kim, Gyeongbuk (KR); Sanggyu Kim, Gyeongbuk (KR); Byunggi Yoon, Gyeongbuk (KR); Minwoo Park, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/710,904

(22) Filed: Dec. 11, 2012

(65) Prior Publication Data

US 2014/0062326 A1 Mar. 6, 2014

(30) Foreign Application Priority Data

Aug. 31, 2012 (KR) ..... 10-2012-0096323

(51) Int. Cl.

| | |
|---|---|
| ***H05B 37/02*** | (2006.01) |
| ***H05B 39/04*** | (2006.01) |
| ***G05F 1/00*** | (2006.01) |
| ***G09G 3/34*** | (2006.01) |
| ***G09G 3/00*** | (2006.01) |

(52) U.S. Cl.

CPC ..... *H05B 37/02* (2013.01); *G09G 3/3406* (2013.01); *G09G 2330/022* (2013.01); *G09G 3/00* (2013.01); *G09G 2320/064* (2013.01)

USPC ..... 315/210; 315/312; 315/291

(58) Field of Classification Search

CPC .. H05B 37/02; H05B 39/045; H05B 41/2825; H05B 37/025; G02F 1/133; G09G 3/20; G09G 3/34; G09G 3/36

USPC ..... 315/210, 312, 291, 292; 345/204

See application file for complete search history.

(56) References Cited

U.S. PATENT DOCUMENTS

| | | | | |
|---|---|---|---|---|
| 7,773,065 | B2 * | 8/2010 | Kumamoto | 345/87 |
| 8,144,108 | B2 * | 3/2012 | Kim | 345/102 |

(Continued)

FOREIGN PATENT DOCUMENTS

| | | |
|---|---|---|
| JP | 2001217082 A | 8/2001 |
| JP | 2003-57711 | 2/2003 |

(Continued)

OTHER PUBLICATIONS

Japanese Office Action for Japanese Application No. 2012-273471 dated Sep. 17, 2013.

(Continued)

*Primary Examiner* — Dylan White

(74) *Attorney, Agent, or Firm* — Morgan, Lewis & Bockius LLP

(57) ABSTRACT

An apparatus for driving a light source of a backlight unit includes: light sources; and a light source driver operating in an idle mode according to an input dimming signal and reducing a dimming value of an output dimming signal for adjusting brightness of the light sources by stages by mixing PWM control and PWM count control in a time-series manner to thus implement low dimming in the idle mode, wherein the dimming value of the output dimming signal is lowered to a first dimming value through the PWM control during a first period and subsequently lowered to a second dimming value lower than the first dimming value through the PWM count control during a second period that follows the first period.

16 Claims, 7 Drawing Sheets

(56) References Cited

U.S. PATENT DOCUMENTS

| | | | | |
|---|---|---|---|---|
| 8,593,391 | B2 * | 11/2013 | Okada et al. | 345/102 |
| 2005/0001801 | A1 * | 1/2005 | Kim | 345/89 |
| 2005/0140640 | A1 * | 6/2005 | Oh et al. | 345/102 |
| 2009/0015601 | A1 * | 1/2009 | Kim | 345/690 |

FOREIGN PATENT DOCUMENTS

| | | |
|---|---|---|
| JP | 2004-253309 | 9/2004 |
| JP | 2005-310997 | 11/2005 |
| JP | 2006-344919 | 12/2006 |
| JP | 2008-124284 | 5/2008 |
| JP | 2012-146577 | 8/2012 |

OTHER PUBLICATIONS

Office Action dated Jan. 21, 2014 from the Japanese Patent Office in counterpart Japanese application No. 2012-273471.

* cited by examiner

APPARATUS AND METHOD FOR DRIVING LIGHT SOURCE IN BACKLIGHT UNIT

This nonprovisional application claims priority under 35 U.S.C. §119(a) on Patent Application No. 10-2012-0096323 filed in Republic of Korea on Aug. 31, 2012, the entire contents of which are hereby incorporated by reference.

BACKGROUND

1. Field

This document relates to a backlight unit irradiating light to a liquid crystal display (LCD) device, and more particularly, to an apparatus and method for driving a light source of a backlight unit.

2. Related Art

Applications of liquid crystal displays (LCDs) tend to extend gradually due to the characteristics that they are lighter and thinner and are driven with low power consumption. LCDs are used in portable computers such as notebook computers, office automation equipment, audio/video equipment, indoor/outdoor advertisement displays, and the like. Transmissive LCDs, making up the majority of LCDs, display an image by adjusting light incident from a backlight unit according to a data voltage by controlling a field applied to a liquid crystal layer.

As a light source of a backlight unit, a fluorescent lamp such as a cold cathode fluorescent lamp (CCFL) has been used, but recently, a light emitting diode (LED) having great advantages in terms of power consumption, weight, luminance, and the like, relative to an exiting fluorescent lamp, is employed. Brightness of a plurality of LEDs is controlled by a light source driver. In order to control brightness of LEDs, a light source driver uses pulse width modulation (PWM) in order to control brightness of LEDs. In the PWM, a duty ratio of an output dimming signal is equal to that of an input PWM signal, but a frequency of the output dimming signal may be independently controlled to be different from that of the input PWM signal. A general output dimming frequency is 10 kHz or higher, namely, very high.

An LCD uses an idle mode for reducing power consumption, in addition to a normal mode for normally displaying an image. In the idle mode, the LCD activates minimum power required for an operation, and in particular, a duty ratio of an output dimming signal is significantly lowered to below a predetermined value (e.g., 0.02%).

However, in the related art light source driving device using PWM, an operation logic of minimum 13 bits or greater is required to calculate an output dimming value of 0.02% or smaller implemented in an idle mode and designing a light source driver is complicated. In addition, in order to implement an output dimming value as low as about 0.02% in an output dimming frequency band as fast as about 20 kHz, a reference clock of 100 MHz or higher is required, and in this case, since the related art light source driver should be designed to process operation data according to the reference clock, a configuration thereof is inevitably complicated. As the light source driver is designed to be complicated, a size of the light source driver is increased and unit cost of a product is increased accordingly.

SUMMARY

An aspect of the present invention provides an apparatus and method for driving a light source of a backlight unit capable of implementing an output dimming value required in an idle mode with a relatively small operation logic and a low reference clock.

In an aspect, an apparatus for driving a light source of a backlight unit includes: light sources; and a light source driver operating in an idle mode according to an input dimming signal and reducing a dimming value of an output dimming signal for adjusting brightness of the light sources by stages by mixing PWM control and PWM count control in a time-series manner to thus implement low dimming in the idle mode, wherein the dimming value of the output dimming signal is lowered to a first dimming value through the PWM control during a first period and subsequently lowered to a second dimming value lower than the first dimming value through the PWM count control during a second period that follows the first period.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

In the drawings.

DETAILED DESCRIPTION

The foregoing and other objects, features, aspects and advantages of the present invention will become more apparent from the following detailed description of the present invention when taken in conjunction with the accompanying drawings.

Embodiments of the present invention will be described in detail with reference to the accompanying drawings.

Figure 1:
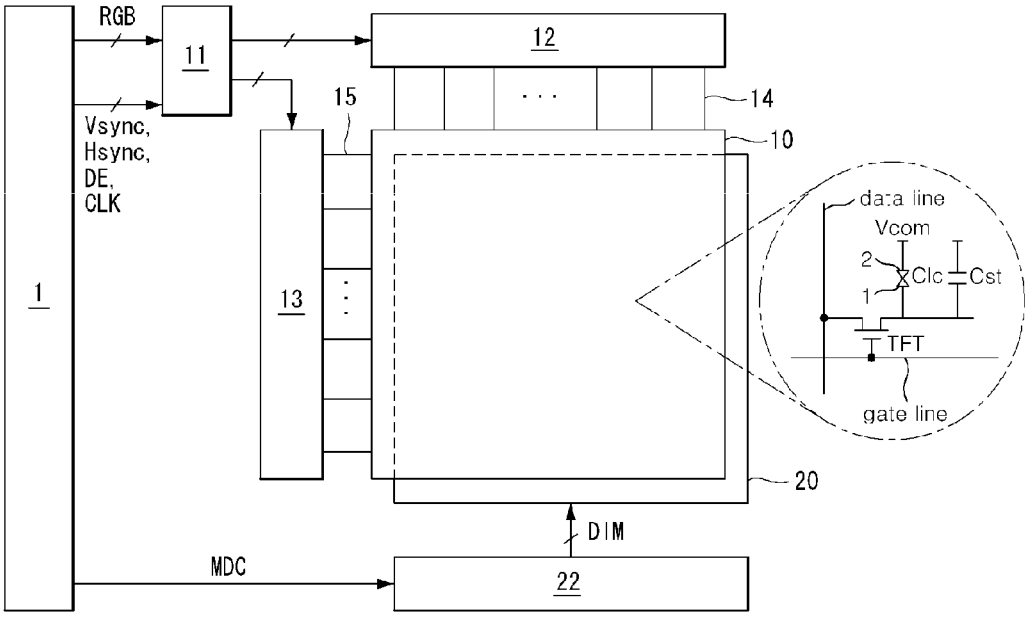
FIG. 1 is a view illustrating a liquid crystal display (LCD) according to an embodiment of the present invention.

FIG. 1 is a view illustrating a liquid crystal display (LCD) according to an embodiment of the present invention.

Referring to FIG. 1, the LCD according to an embodiment of the present invention includes a liquid crystal display panel 10, a backlight unit 20 irradiating light to the liquid crystal panel 10, a light source driver 22 driving light sources of the backlight unit 20, a source driver 12 driving data lines 14 of the liquid crystal display panel 10, a gate driver 13 driving gate lines 15 of the liquid crystal display panel 10, a timing controller 11, and a host system 1.

The liquid crystal display panel 10 includes a liquid crystal layer formed between two sheets of glass substrates A plurality of data lines 14 and a plurality of gate lines 15 cross on a lower glass substrate of the liquid crystal display panel 10. Liquid crystal cells Clc are disposed in a matrix form on the liquid crystal display panel 10 according to a crossing structure of the data lines 14 and the gate lines 15. The data lines 14, the gate lines 15, thin film transistors (TFTs), a pixel electrode 1 of the liquid crystal cell Clc connected to each TFT, a storage capacitor Cst, and the like, are formed on the lower glass substrate of the liquid crystal display panel 10.

Black matrices, color filters, a common electrode 2 are formed on an upper glass substrate of the liquid crystal panel 10. The common electrode 2 is formed on the upper glass substrate in a vertical electric field driving method (or a vertical field switching mode) such as a twisted nematic (TN) mode and a vertical alignment (VA) mode, and is formed together with the pixel electrode 1 on the lower glass substrate in a horizontal electric field driving method such as an in-plane field switching mode such as an in-plane switching (IPS) mode or a fringe field switching (FFS) mode. A polarizer is attached to each of the upper glass substrate and the lower glass substrate of the liquid crystal panel 10 and an alignment film for setting a pretilt angle of liquid crystal is formed on an inner surface thereof in contact with the liquid crystal.

The backlight unit 20 includes a plurality of light sources driven by the light source driver 22 to irradiate light to the liquid crystal panel 10. LEDs having advantages in terms of power consumption, weight, luminance, and the like, may be selected as light sources, but the present invention is not limited thereto. The backlight unit 20 may be implemented as an edge type backlight unit in which light source channels are disposed to face a lateral surface of a light guide plate, or may be implemented as a direct type backlight unit in which light sources are disposed below a diffusion plate. The edge type backlight unit 20 converts light generated from light source channel into uniform surface light source by using a light guide plate and a plurality of optical sheets laminated on the light guide plate to irradiate light to the liquid crystal display panel 10. The direct type backlight unit 20 converts light generated from light sources into uniform surface light source through a diffusion plate and a plurality of optical sheets laminated thereon to irradiate light to the liquid crystal panel 10.

The source driver 12 latches digital video data RGB under the control of the timing controller 11. The source driver 12 converts digital video data RGB into positive polarity/negative polarity analog data voltage by using a positive polarity/negative polarity gamma compensation reference voltage and supplies the same to the data lines 14.

The gate driver 13 includes a shift register, a level shifter for converting an output signal from the shift register into a swing appropriate for driving TFTs of liquid crystal cells, an output buffer, and the like. The gate driver 13 sequentially outputs gate pulses having a pulse width of a substantially one horizontal period and supplies the same to the gate lines 15.

The timing controller 11 receives the digital video data RGB and timing signals Vsync, Hsync, DE, and CLK from the host system 1 to supply the digital video data RGB to the source driver 12, and generates timing control signals for controlling an operation timing of the source driver 12 and the gate driver 13. The timing controller 11 may analyze an input image and control the light source driver 22 according to a local dimming method such that a dynamic range of a displayed image extends according to the analysis result.

The host system 1 may be implemented as any one of a television system, a navigation system, a set-top box, a DVD player, a Blu-ray player, a personal computer (PC), a home theater system, and a phone system. The host system 1 converts digital video data RGB of an input image into a format appropriate for resolution of the liquid crystal display panel 20 by using a scaler, and transmits the timing signals Vsync, Hsync, DE, and CLK together with the data RGB to the timing controller 11.

The host system 1 may operate the light source driver 22 in an idle mode by adjusting an input dimming signal DMC to be supplied to the light source driver 22 in response to user data. The input dimming signal DMC for controlling an operation of the light source driver 22 into the idle mode may be selected to have a dimming value which is considerably low relative to an input dimming signal in a normal mode. The user may select the idle mode by applying user data to the host system 1 through a user interface (UI). The user interface (UI) may be implemented as a keypad, a keyboard, a mouse, an on-screen display (OSD), a remote controller, a graphic user interface (GUI), a touch UI, a voice recognition UI, a 3D UI, and the like.

The light source driver 22 adjusts luminance of light irradiated to the liquid crystal display panel 10 by adjusting an output dimming value DIM for controlling brightness of light source channels according to the input dimming signal MDC applied from the host system 1.

When the dimming value of the input dimming signal MDC is greater than a predetermined reference dimming value, the light source driver 22 operates in the normal mode. In the normal mode, the light source driver 22 makes the dimming value DIM of the output dimming signal correspond to the input dimming signal MDC according to a PWM method.

Meanwhile, when the dimming value of the input dimming signal MDC is equal to or smaller than the predetermined reference dimming value, the light source driver 22 operates in the idle mode. In the idle mode, the light source driver 22 implements low dimming by making the dimming value DIM of the output dimming signal correspond to the dimming value of the input dimming signal MDC according to the PWM method and a PWM count method. For low dimming, the light source driver 22 derives the desired output dimming value DIM by lowering the dimming value by stages by mixing the PWM method and the PWM count method in a time-series manner. In other words, the light source driver 22 lowers the dimming value DIM of the output dimming signal to a first dimming value through PWM control during a first period, and lowers the dimming value DIM to a second dimming value lower than the first dimming value through PWM count control during a second period that follows the first period. By mixing the PWM method and the PWM count method in a time-series manner, the light source driver 22 may implement the desired dimming value DIM of the output dimming signal in the idle mode by a relatively small calculation logic and low reference clock. A size of the calculation logic and a speed of the reference clock may be related only to calculation of a PWM duty ratio in PWM control.

The light source driver 22 may implement low dimming only by mixing the PWM method and the PWM count method in a time-series manner, or may implement low dimming by further including an analog dimming method in addition to the PWM method and the PWM count method. The analog dimming method may be selectively performed between a PWM control period (the first period) and the PWM count control method (the second period) mixed in a time-series manner, before the PWM control period, or after the PWM cont control period.

An operation of the light source driver 22 for implementing low dimming may be divided into the following three embodiments according to a timing at which an analog dimming control period is disposed. In the following embodiments, it is assumed that an output dimming value DIM for implementing low dimming is 0.02%, but a technical concept of the present invention is not limited to a specific numeral value of the output dimming value DIM.

First Embodiment of Operation of Light Source Driver 22

Figure 2:
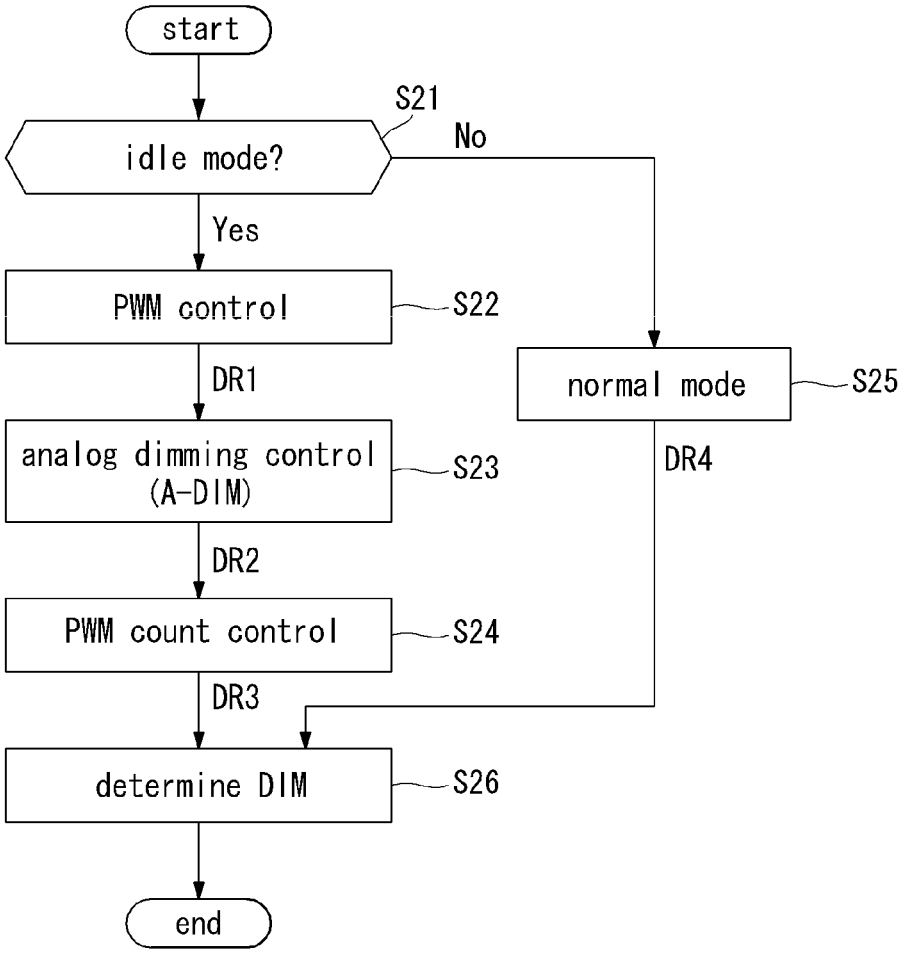
FIG. 2 is a flow chart illustrating an example of an operation of a light source driver for implementing low dimming.
Figure 3:
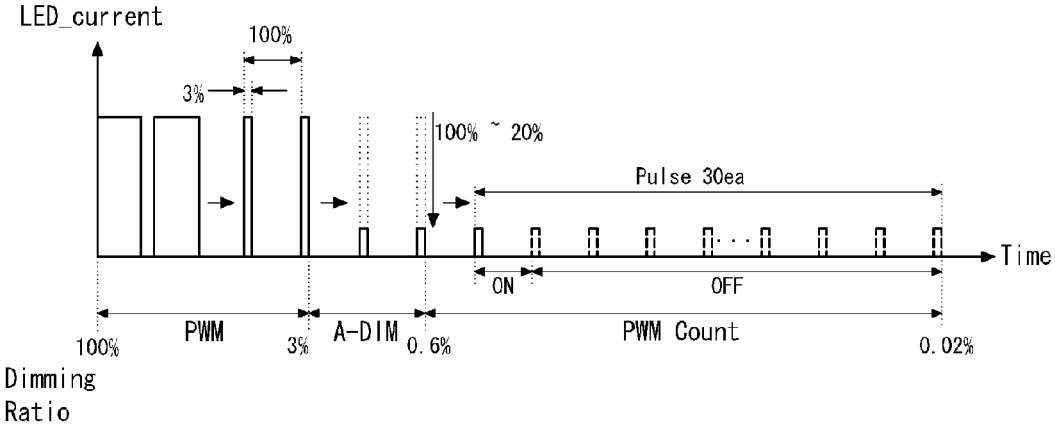
FIG. 3 is a view illustrating a concept of controlling an output dimming value according to the operation of FIG. 2.

FIG. 2 is a flow chart illustrating an example of an operation of the light source driver 22 for implementing low dimming. FIG. 3 is a view illustrating a concept of controlling an output dimming value according to the operation of FIG. 2.

The light source driver 22 according to a first embodiment further performs analog dimming control between PWM control and PWM count control which are sequentially performed. In order to implement low dimming, the light source driver 22 lowers the dimming value DIM of the output dimming signal to a first dimming value during a PWM control period, lowers the dimming value DIM to a second dimming value during an analog dimming control period, and subsequently lowers the dimming value DIM to a third dimming value during a PWM count control period, thus implementing the output dimming value DIM of 0.02%. A size of a calculation logic and a speed of a reference clock are dependently only upon the first dimming value according to PWM control and irrelevant to the second and third dimming values. Thus, since the light source driver 22 further performs analog dimming control selectively together with PWM count control, it can sufficiently implement the 0.02% output dimming value DIM by an 8-bit calculation logic for calculating the first dimming value (e.g., 3%) and a reference clock of about 1 MHz.

Referring to FIGS. 2 and 3, when the dimming value of the input dimming signal is equal to or smaller than the predetermined reference dimming value (i.e., 0.02%), the light source driver 22 enters an idle mode, implementing low dimming (S21). The light source driver 22 time-divides the dimming control period, required for making the dimming value DIM of the output dimming signal correspond to the dimming value of the input dimming signal, sequentially into the PWM control period, the analog dimming control (A-DIM) period, and the PWM count control period.

The light source driver 22 varies a PWM duty of the output dimming signal within a range from 100% to 3% during the PWM control period to lower the dimming value DIM of the output dimming signal down to 3%, a first dimming value DR1 (S22). When a maximum value of an output dimming frequency is set to 20 kHz, a minimum reference clock required for calculating 3% PWM duty is about 666 kHz ($1 \div 20[\text{kHz}] \times 0.03 = 1.5 \times 10^{-6}[\text{sec}] \approx 666[\text{kHz}]$), so 1 MHz may be sufficient as an appropriate reference clock. Also, when the calculation logic has 8 bits, it can calculate up to 0.4% (1/256=0.004), so the 8-bit calculation logic may be sufficient to calculate the 3% PWM duty.

Thereafter, in order to lower the dimming value DIM of the output dimming signal from 3% down to 0.02%, the light source driver 22 uses the analog dimming control (A-DIM) period and the PWM count control period irrespective of a size of a calculation logic and a speed of a reference clock. The light source driver 22 lowers the dimming value DIM of the output dimming signal down to 0.6% ($0.03 \times 0.2 = 0.006 = 0.6\%$), a second dimming value DR2, by varying a light source driving current within a range from 100% to 20% during the analog dimming control (A-DIM) period (S23). Subsequently, the light source driver 22 counts PWM pulses of the second dimming value (i.e., 0.6%) in units of certain number (e.g., 30) during the PWM count control period and subsequently turns off (indicated by the dotted line in FIG. 3) some (e.g., 29) of the counted PWM pulses to thus lower the dimming value DIM of the output dimming signal down to 0.02% ($0.006 \times 1/30 = 0.0002 = 0.02\%$), a third dimming value DR3 (S24). The light source driver 22 determines the third dimming value DR3 as a dimming value DIM of the output dimming signal, implementing low dimming (S26).

Meanwhile, when the dimming value of the input dimming signal is greater than the predetermined reference dimming value, the light source driver 22 enters a normal mode and determines a fourth dimming value DR4 equal to the dimming value of the input dimming signal, as a dimming value DIM of the output dimming signal, thus implementing normal dimming (S25, S26).

Second Embodiment of Operation of Light Source Driver 22

Figure 4:
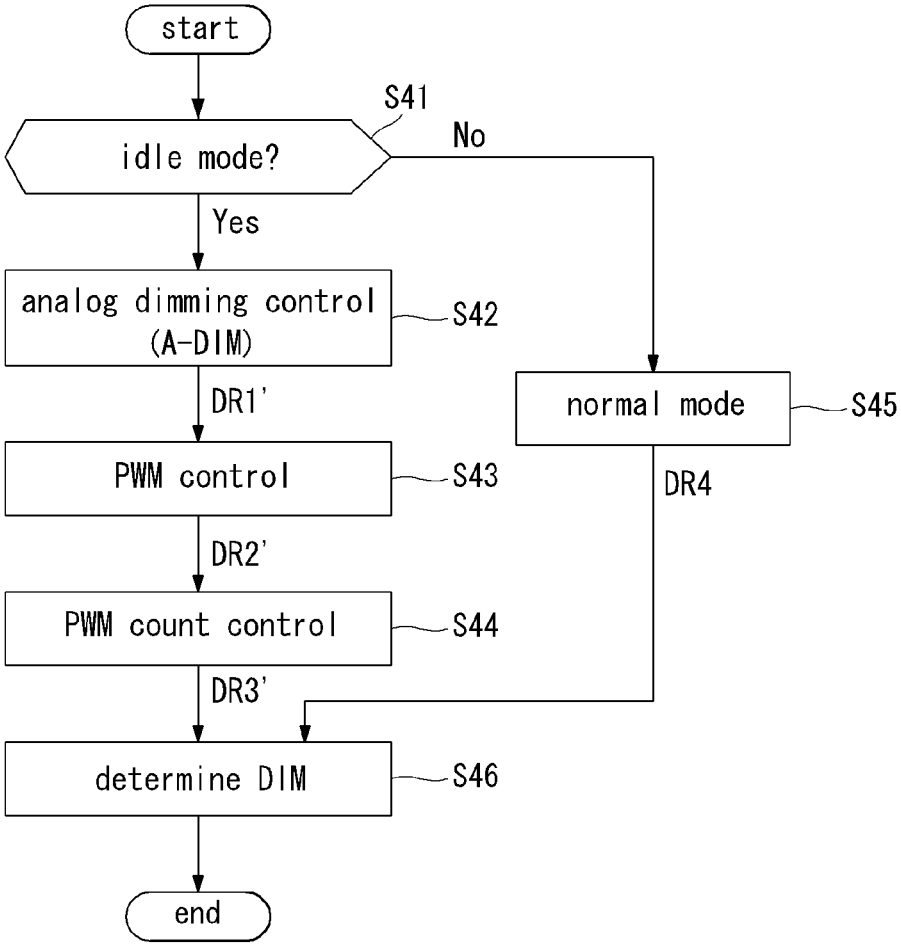
FIG. 4 is a flow chart illustrating another example of an operation of the light source driver for implementing low dimming.
Figure 5:
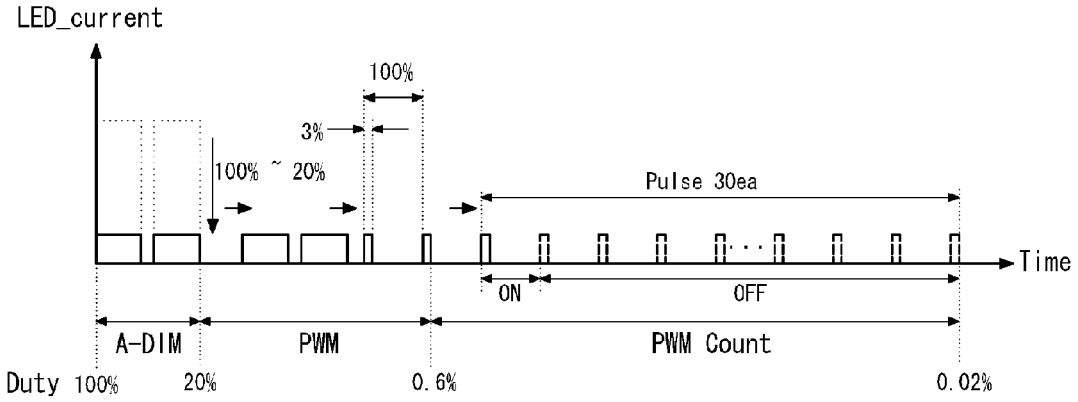
FIG. 5 is a view illustrating a concept of controlling an output dimming value according to the operation of FIG. 4.

FIG. 4 is a flow chart illustrating another example of an operation of the light source driver 22 for implementing low dimming. FIG. 5 is a view illustrating a concept of controlling an output dimming value DIM according to the operation of FIG. 4.

The light source driver 22 according to the second embodiment of the present invention further performs analog dimming control before the PWM control and the PWM count control which are sequentially performed. Namely, the light source driver 22 further performs analog dimming control before the PWM control. In order to implement low dimming, the light source driver 22 lowers the dimming value DIM of the output dimming signal to a first dimming value during the analog dimming control period, lowers the dimming value DIM to a second dimming value during the PWM control period, and subsequently lowers the dimming value DIM to a third dimming value during the PWM count control period, thus implementing the output dimming value DIM of 0.02%. A size of a calculation logic and a speed of a reference clock are dependently only upon the second dimming value according to PWM control and irrelevant to the first and third dimming values. Thus, since the light source driver 22 further performs analog dimming control selectively together with PWM count control, it can sufficiently implement the 0.02% output dimming value DIM by an 8-bit calculation logic for calculating the second dimming value (e.g., 0.6%) and a reference clock of about 4 MHz.

Referring to FIGS. 4 and 5, when the dimming value of the input dimming signal is equal to or smaller than the predetermined reference dimming value (i.e., 0.02%), the light source driver 22 enters an idle mode, implementing low dimming (S41). The light source driver 22 time-divides a dimming control period, required for making the dimming value DIM of the output dimming signal correspond to the dimming value of the input dimming signal, sequentially into the analog dimming control (A-DIM) period, the PWM control period, and the PWM count control period. The analog dimming control (A-DIM) period and the PWM count control period are operated irrespective of a size of the calculation logic and a speed of the reference clock.

The light source driver 22 lowers the dimming value DIM of the output dimming signal down to 20%, a first dimming value DR1' by varying a light source driving current within a range from 100% to 20% during the analog dimming control (A-DIM) period (S42).

Subsequently, the light source driver 22 varies a PWM duty of the output dimming signal having the first dimming value DR1' within a range from 100% to 3% during the PWM control period to lower the dimming value DIM of the output dimming signal down to 0.6%, a second dimming value DR2'

(S43). When a maximum value of an output dimming frequency is set to 20 kHz, a minimum reference clock required for calculating 0.6% PWM duty is about 3.33 MHz (1÷20 [kHz]×0.006=3×10−7[sec]≈3.33[MHz]), so 4 MHz may be sufficient as an appropriate reference clock. Also, when the calculation logic has 8 bits, it can calculate up to 0.4% (1/256=0.004), so the 8-bit calculation logic may be sufficient to calculate the 0.6% PWM duty.

Thereafter, the light source driver 22 counts PWM pulses of the second dimming value (i.e., 0.6%) in units of certain number (e.g., 30) during the PWM count control period and subsequently turns off (indicated by the dotted line in FIG. 5) some (e.g., 29) of the counted PWM pulses to thus lower the output dimming value DIM down to 0.02% (0.006×1/30=0.0002=0.02%), a third dimming value DR3' (S44). The light source driver 22 determines the third dimming value DR3' as a dimming value DIM of the output dimming signal, implementing low dimming (S46).

Meanwhile, when the dimming value of the input dimming signal is greater than the predetermined reference dimming value, the light source driver 22 enters a normal mode and determines a fourth dimming value DR4 equal to the dimming value of the input dimming signal, as a dimming value DIM of the output dimming signal, thus implementing normal dimming (S45, S46).

Third Embodiment of Operation of Light Source Driver 22

Figure 6:
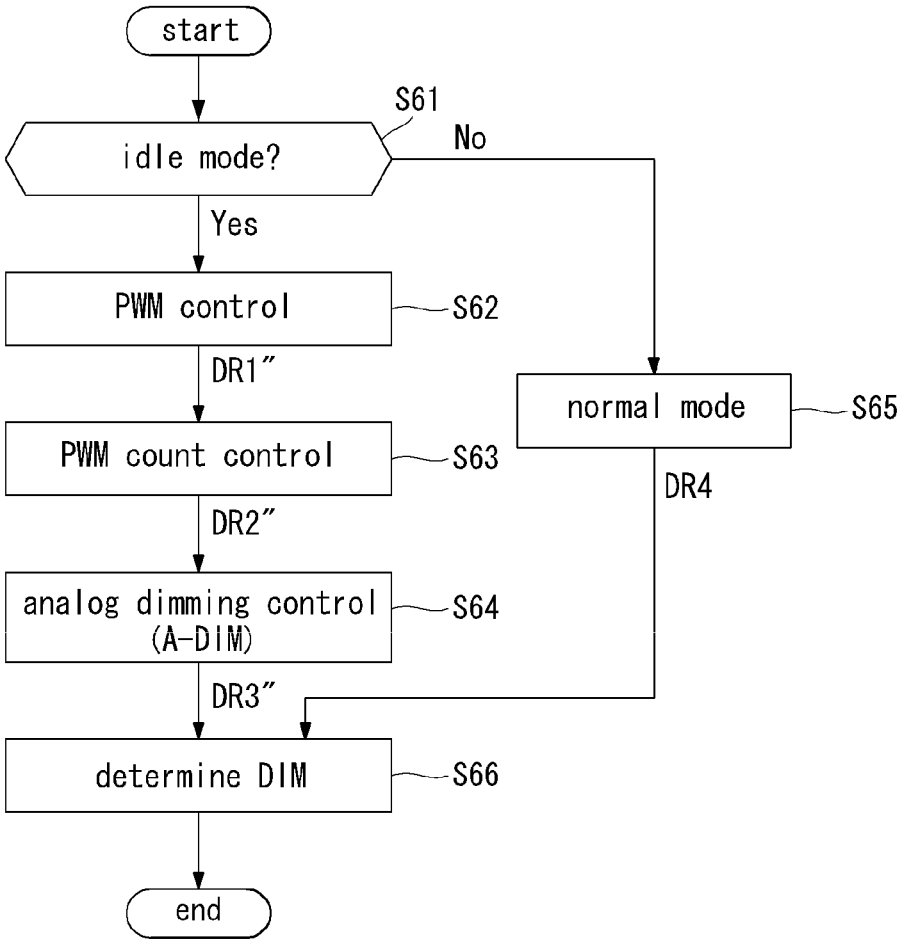
FIG. 6 is a flow chart illustrating still another example of an operation of the light source driver for implementing low dimming.
Figure 7:
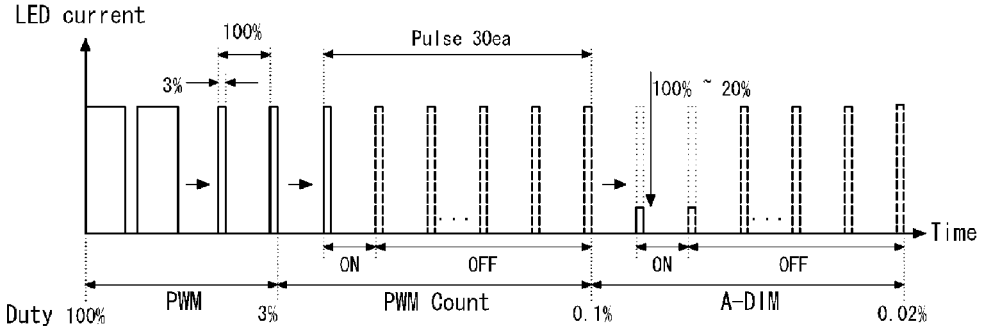
FIG. 7 is a view illustrating a concept of controlling an output dimming value according to the operation of FIG. 6.

FIG. 6 is a flow chart illustrating still another example of an operation of the light source driver 22 for implementing low dimming. FIG. 7 is a view illustrating a concept of controlling an output dimming value according to the operation of FIG. 6.

The light source driver 22 according to the third embodiment of the present invention further performs analog dimming control after the PWM control and the PWM count control which are sequentially performed. Namely, the light source driver 22 further performs analog dimming control after the PWM count control. In order to implement low dimming, the light source driver 22 lowers the dimming value DIM of the output dimming signal to a first dimming value during a PWM control period, lowers the dimming value DIM to a second dimming value during the PWM count control period, and subsequently lowers the dimming value DIM to a third dimming value during the analog dimming control period, thus implementing the output dimming value DIM of 0.02%. A size of a calculation logic and a speed of a reference clock are dependently only upon the first dimming value according to PWM control and irrelevant to the second and third dimming values. Thus, since the light source driver 22 further performs analog dimming control selectively together with PWM count control, it can sufficiently implement the 0.02% output dimming value DIM by an 8-bit calculation logic for calculating the first dimming value (e.g., 3%) and a reference clock of about 1 MHz.

Referring to FIGS. 6 and 7, when the dimming value of the input dimming signal is equal to or smaller than the predetermined reference dimming value (i.e., 0.02%), the light source driver 22 enters an idle mode, implementing low dimming (S61). The light source driver 22 time-divides the dimming control period, required for making the dimming value DIM of the output dimming signal correspond to the dimming value of the input dimming signal, sequentially into the PWM control period, the PWM count control period, and the analog dimming control period.

The light source driver 22 varies a PWM duty of the output dimming signal within a range from 100% to 3% during the PWM control period to lower the dimming value DIM of the output dimming signal down to 3%, a first dimming value DR1" (S62). When a maximum value of an output dimming frequency is set to 20 kHz, a minimum reference clock required for calculating 3% PWM duty is about 666 kHz (1÷20[kHz]×0.03=1.5×10−6[sec]≈666[kHz]), so 1 MHz may be sufficient as an appropriate reference clock. Also, when the calculation logic has 8 bits, it can calculate up to 0.4% (1/256=0.004), so the 8-bit calculation logic may be sufficient to calculate the 3% PWM duty.

Thereafter, in order to lower the dimming value DIM of the output dimming signal from 3% down to 0.02%, the light source driver 22 uses the analog dimming control (A-DIM) period and the PWM count control period irrespective of a size of a calculation logic and a speed of a reference clock. The light source driver 22 counts PWM pulses of the first dimming value (i.e., 3%) in units of certain number (e.g., 30) during the PWM count control period and subsequently turns off (indicated by the dotted line in FIG. 7) some (e.g., 29) of the counted PWM pulses to thus lower the dimming value DIM of the output dimming signal down to 0.1% (0.03×1/30=0.001=0.1%), a second dimming value DR2" (S63). Subsequently, the light source driver 22 lowers the dimming value DIM of the output dimming signal down to 0.02% (0.001×0.2=0.0002=0.02%), a third dimming value DR3", by varying a light source driving current within a range from 100% to 20% during the analog dimming control (A-DIM) period (S64). The light source driver 22 determines the third dimming value DR3" as a dimming value DIM of the output dimming signal, implementing low dimming (S66).

Meanwhile, when the dimming value of the input dimming signal is greater than the predetermined reference dimming value, the light source driver 22 enters a normal mode and determines a fourth dimming value DR4" equal to the dimming value of the input dimming signal, as a dimming value DIM of the output dimming signal, thus implementing normal dimming (S65, S66).

As described above, in the embodiments of the present invention, by mixing the PWM method and the PWM count method in a time-series manner or further mixing the analog dimming method to the PWM method and the PWM count method in the time-series manner, low dimming can be implemented by a relatively small calculation logic and low reference clock. Thus, the design of the light source driver can be simplified to have a smaller size, and thus, production unit cost can be reduced.

While the present invention has been shown and described in connection with the embodiments, it will be apparent to those skilled in the art that modifications and variations can be made without departing from the spirit and scope of the invention as defined by the appended claims.

What is claimed is:

1. An apparatus for driving a light source of a backlight unit comprising:

light sources; and a light source driver operating in an idle mode according to an input dimming signal and reducing a dimming value of an output dimming signal for adjusting brightness of the light sources by stages by mixing PWM control and PWM count control in a time-series manner to thus implement low dimming in the idle mode, wherein the dimming value of the output dimming signal is lowered to a first dimming value through the PWM control during a first period and subsequently lowered to a second dimming value lower than the first dimming value through the PWM count control during a second period that follows the first period, and wherein the PWM count control counts PWM pulses of the first dimming value in units of certain number and subsequently turns off some of the counted PWM pulses.

2. The apparatus of claim 1, wherein the light source driver lowers the dimming value of the output dimming signal by stages by further mixing analog dimming control together with the PWM control and the PWM count control in time-series manner to implement low dimming in the idle mode.

3. The apparatus of claim 2, wherein the dimming value of the output dimming signal is controlled as a third dimming value between the first dimming value and the second dimming value according to the analog dimming control during a third period between the first period and the second period.

4. The apparatus of claim 3, wherein the light source driver adjusts a PWM duty of the output dimming signal to lower the dimming value of the output dimming signal to the first dimming value;

counts PWM pulses constituting the output dimming signal in units of certain number and turns off some of the counted PWM pulses in order to lower the dimming value of the output dimming signal to the second dimming value; and adjusts a light source driving current in order to lower the dimming value of the output dimming signal down to the third dimming value.

5. The apparatus of claim 2, wherein the dimming value of the output dimming signal is controlled as a third dimming value greater than the first dimming value according to the analog dimming control during the third period before the first period.

6. The apparatus of claim 5, wherein the light source driver adjusts a PWM duty of the output dimming signal to lower the dimming value of the output dimming signal to the first dimming value;

counts PWM pulses constituting the output dimming signal in units of certain number and turns off some of the counted PWM pulses in order to lower the dimming value of the output dimming signal to the second dimming value; and adjusts a light source driving current in order to lower the dimming value of the output dimming signal down to the third dimming value.

7. The apparatus of claim 2, wherein the dimming value of the output dimming signal is controlled as a third dimming value smaller than the second dimming value according to the analog dimming control during the third period following the second period.

8. The apparatus of claim 7, wherein the light source driver adjusts a PWM duty of the output dimming signal to lower the dimming value of the output dimming signal to the first dimming value;

counts PWM pulses constituting the output dimming signal in units of certain number and turns off some of the counted PWM pulses in order to lower the dimming value of the output dimming signal to the second dimming value; and adjusts a light source driving current in order to lower the dimming value of the output dimming signal down to the third dimming value.

9. A method for driving a light source of a backlight unit, the method comprising:

operating in an idle mode according to an input dimming signal, and lowering a dimming value of an output dimming signal by stages by mixing PWM control and PWM count control in a time-series manner in order to implement low dimming in the idle mode; and adjusting brightness of light sources by driving the light sources according to the output dimming signal, wherein the dimming value of the output dimming signal is lowered to a first dimming value through the PWM control during a first period and subsequently lowered to a second dimming value lower than the first dimming value through the PWM count control during a second period that follows the first period, and wherein the PWM count control counts PWM pulses of the first dimming value in units of certain number and subsequently turns off some of the counted PWM pulses.

10. The method of claim 9, wherein, in lowering the dimming value of the output dimming signal by stages, analog dimming control is further mixed together with the PWM control and the PWM count control in the time-series manner.

11. The method of claim 10, wherein the dimming value of the output dimming signal is controlled as a third dimming value between the first dimming value and the second dimming value according to the analog dimming control during a third period between the first period and the second period.

12. The method of claim 11, wherein the lowering of the dimming value of the output dimming signal comprises:

adjusting a PWM duty of the output dimming signal to lower the dimming value of the output dimming signal to the first dimming value;

counting PWM pulses constituting the output dimming signal in units of certain number and turning off some of the counted PWM pulses in order to lower the dimming value of the output dimming signal to the second dimming value; and adjusting a light source driving current in order to lower the dimming value of the output dimming signal down to the third dimming value.

13. The method of claim 10, wherein the dimming value of the output dimming signal is controlled as a third dimming value greater than the first dimming value according to the analog dimming control during the third period before the first period.

14. The method of claim 13, wherein the lowering of the dimming value of the output dimming signal comprises:

adjusting a PWM duty of the output dimming signal to lower the dimming value of the output dimming signal to the first dimming value;

counting PWM pulses constituting the output dimming signal in units of certain number and turning off some of the counted PWM pulses in order to lower the dimming value of the output dimming signal to the second dimming value; and adjusting a light source driving current in order to lower the dimming value of the output dimming signal down to the third dimming value.

15. The method of claim 10, wherein the dimming value of the output dimming signal is controlled as a third dimming value smaller than the second dimming value according to the analog dimming control during the third period following the second period.

16. The method of claim 15, wherein the lowering of the dimming value of the output dimming signal comprises:

adjusting a PWM duty of the output dimming signal to lower the dimming value of the output dimming signal to the first dimming value;

counting PWM pulses constituting the output dimming signal in units of certain number and turning off some of the counted PWM pulses in order to lower the dimming value of the output dimming signal to the second dimming value; and adjusting a light source driving current in order to lower the dimming value of the output dimming signal down to the third dimming value.

* * * * *